US005114026A

United States Patent [19]

Van Ketel Hendrik

[11] Patent Number: 5,114,026

[45] Date of Patent: May 19, 1992

[54] HOISTING DEVICES

[75] Inventor: Van Ketel Hendrik, Maasslius, Netherlands

[73] Assignee: Heerema Group Services B.V., Leiden, Netherlands

[21] Appl. No.: 608,028

[22] Filed: Oct. 30, 1990

Related U.S. Application Data

[63] Continuation of Ser. No. 256,603, Oct. 2, 1988, abandoned.

[30] Foreign Application Priority Data

Oct. 12, 1987 [GB] United Kingdom ..... 8723898

[51] Int. Cl.[5] ..... B66C 23/53

[52] U.S. Cl. ..... 212/191; 254/285; 254/900; 414/139.6

[58] Field of Search ..... 212/148, 107, 191, 262, 212/190; 242/54 R, 107.1; 254/281, 283, 284, 285, 286, 288, 291, 292, 293, 304, 339, 340, 900, 290; 414/139.6

[56] References Cited

U.S. PATENT DOCUMENTS

| | | | |
|---|---|---|---|
| 2,045,533 | 6/1936 | Smaltz | 212/167 |
| 3,467,360 | 9/1969 | Mizell | 242/54 R |
| 3,918,653 | 11/1975 | Harms et al. | 242/54 R |
| 4,147,330 | 4/1979 | Eik | 414/139.6 |
| 4,157,812 | 6/1979 | Bennett | 242/107.1 |
| 4,223,871 | 9/1980 | Braithwaite | 254/291 |
| 4,324,385 | 4/1982 | Cojean et al. | 414/139.6 |

FOREIGN PATENT DOCUMENTS

| | | | |
|---|---|---|---|
| 2374254 | 8/1978 | France | 414/139.6 |
| 2388754 | 12/1978 | France | 414/139.6 |
| 54-40460 | 3/1979 | Japan | 254/291 |
| 663660 | 5/1979 | U.S.S.R. | 254/285 |
| 727558 | 4/1980 | U.S.S.R. | 254/285 |
| 872443 | 10/1981 | U.S.S.R. | 254/285 |

*Primary Examiner*—Sherman Basinger
*Assistant Examiner*—Thomas J. Brahan

[57] ABSTRACT

A hoisting device comprises a cable controlled at one end by a conventional crane winch assembly and at the other end by a traction winch assembly comprising traction device and storage winch. The hook is raised and lowered using the crane winch assembly and/or traction winch assembly depending upon whether the operation requires critical control or long haul travel.

6 Claims, 6 Drawing Sheets

HOISTING DEVICES

This is a continuation of copending application Ser. No. 07/256,603, filed on Oct. 12, 1988 now abandoned.

BRIEF SUMMARY OF THE INVENTION

The invention provides a hoisting device having load pick-up tackle, means for suspending the load pick-up tackle, and means for raising or lowering the load pick-up tackle, which means for raising or lowering the load pick-up tackle includes a winch assembly for critical ranges of operation requiring relatively fine control and a traction winch assembly for non-critical operating ranges.

The invention also provides a method of handling loads comprising using a hoisting device as defined above, connecting a load to the load pick-up tackle and selectively using the winch assembly and/or traction winch assembly for raising or lowering the load.

By way of example, embodiments of the invention will now be described with reference to the accompanying drawings.

DESCRIPTION OF THE PREFERRED EMBODIMENTS

Figure 1:
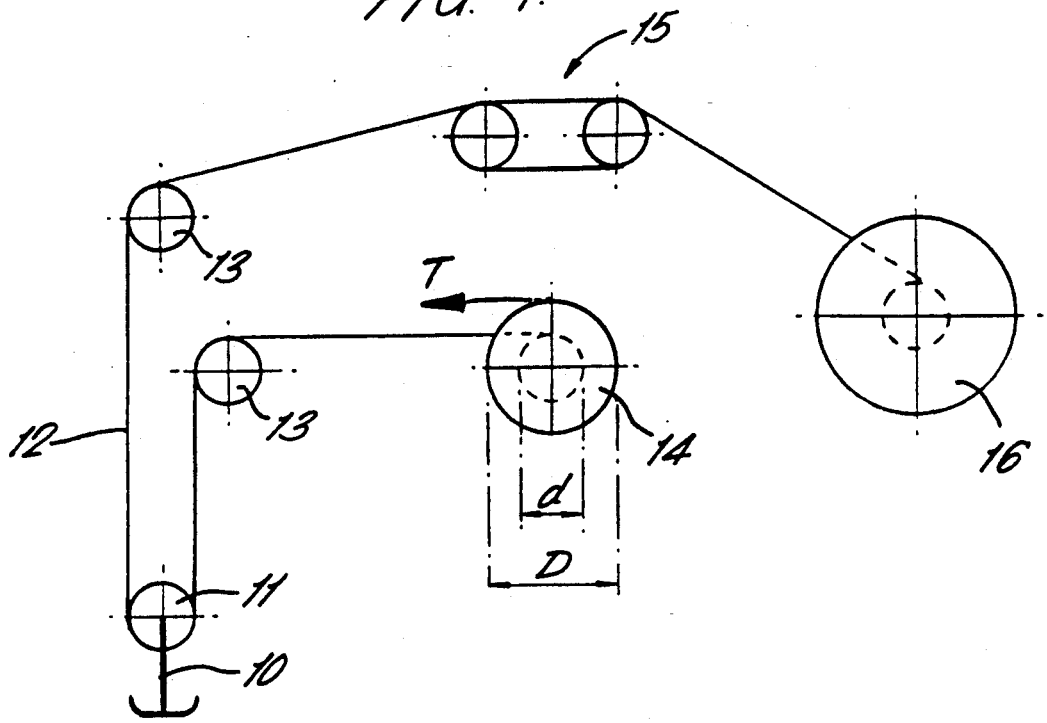
FIG. 1 illustrates a hoisting device in accordance with the present invention.

There is seen in FIG. 1 a hoisting device which includes load pick-up tackle with a hook 10 and a pulley block 11 which is suspended by a cable 12 from upper pulley blocks 13. One end of the cable 12 is wound onto the drum of a conventional crane winch assembly 14. This much of the arrangement is similar to a conventional crane arrangement, and in a conventional crane arrangement, the other end of the cable would be wound onto a second crane winch assembly or be a dead end.

Using a conventional crane winch, there is a limit to the amount of cable which can be stored on the drum for given sizes of cable and drum. The minimum drum diameter d depends upon the cable diameter, because a certain minimum ratio between cable and drum diameter must be obeyed. For a given drum length, the cable can only be allowed to wrap around the drum to a certain maximum diameter D, at which point the effective torque from the tension T in the cable corresponds with the maximum allowable torque for the winch. Therefore, it is a problem to provide a hoisting device which can be used effectively in long-travel applications, e.g., installation of sub-sea modules in deep water. In the present arrangement, however, the other end of the cable 12 passes to a traction winch assembly, i.e. through a traction device 15 and onto the drum of an active storage winch 16. The traction winch assembly is seen in more detail in FIG. 2.

Figure 2:
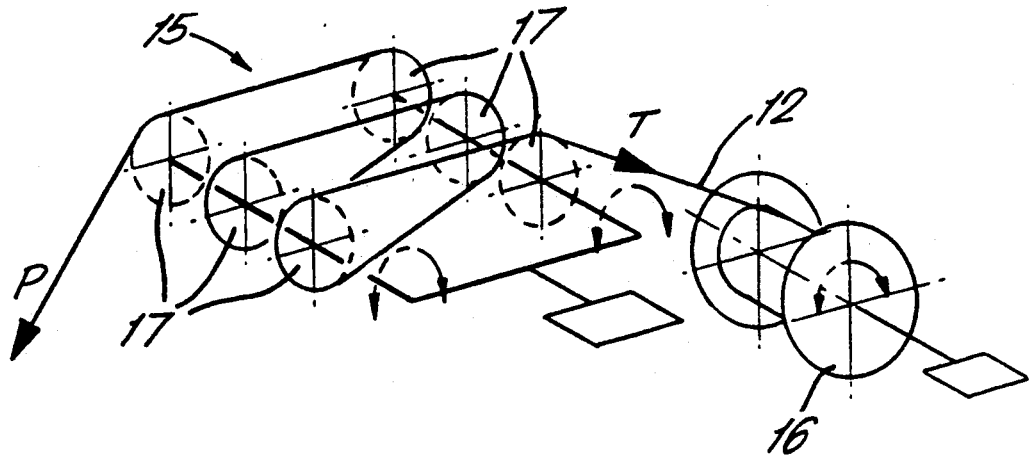
FIG. 2 shows the traction winch assembly in more detail.

As is seen in FIG. 2, the traction device 15 of the traction winch assembly comprises a plurality of traction drums 17 around which the cable 12 is wrapped. The traction device 15 makes use of the fact that the tension in a cable can be reduced if it is wrapped around a drum. The amount of the reduction in tension is given by the ratio $1:e^{fx}$ where e is the natural logarithm, f is the coefficient of friction between the cable and the drum and x is the arc of contact in radians. Thus, using a suitable array of traction drums 17, the traction device 15 can be used to reduce line pull P in the cable 12 to an acceptable tension T for the storage winch 16. The storage winch 16 can therefore be used to store a great quantity of cable, without problems from excessive torque effects, and a constant tension type winch can be used.

It will be seen that the hook 10 of the hoisting device of FIG. 1 can be raised and lowered using the crane winch assembly 14 and/or the traction winch assembly 15, 16.

Figure 3:
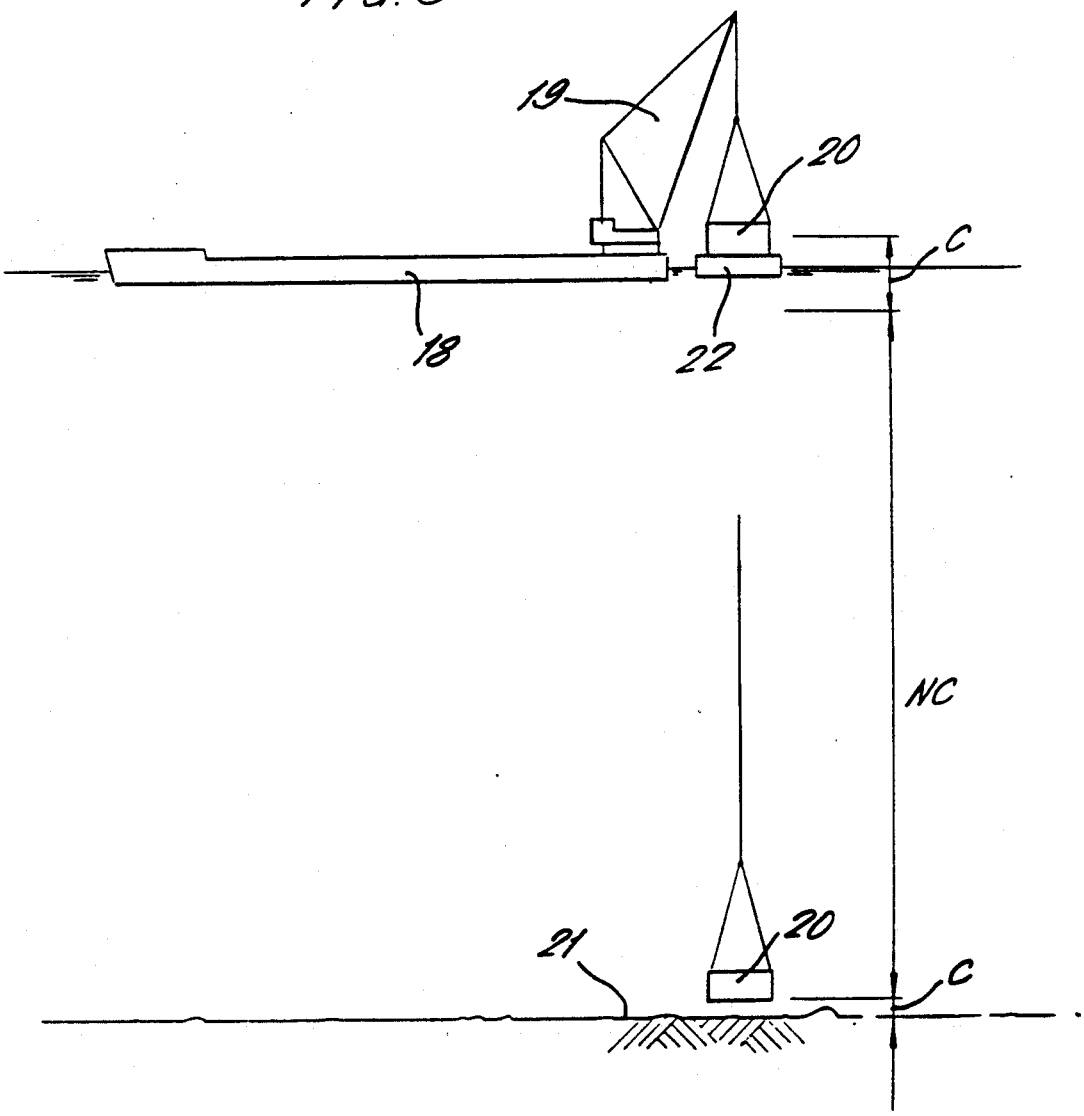
FIG. 3 illustrates an installation vessel for which the hoisting device is particularly suited.

There is seen in FIG. 3 a crane vessel 18 with its crane 19 arranged as per the hoisting device of FIG. 1. The vessel 18 is to install a module 20, e.g., a template, on the sea bed 21 at a deep water location. A cargo barge 22 is used to carry the module 20 to the site. Certain phases of the installation procedure are critical and need high hoisting or lowering speed and short acceleration periods; these include: lifting from the cargo barge, passing the waterline, and setting down on the sea bed. The crane winch assembly 14 is used for normal operation (i.e. all operations above water) and during the critical phases, which are indicated by C in FIG. 3. The traction winch assembly 15, 16 is used for long haul block travel, i.e., the non-critical phase which is indicated by NC in FIG. 3. Used in this way, the acceleration time of the traction winch assembly can be kept to a moderate level, which avoids the need for a complicated control system to ensure constant tension between the traction device 15 and storage winch 16.

Figure 4:
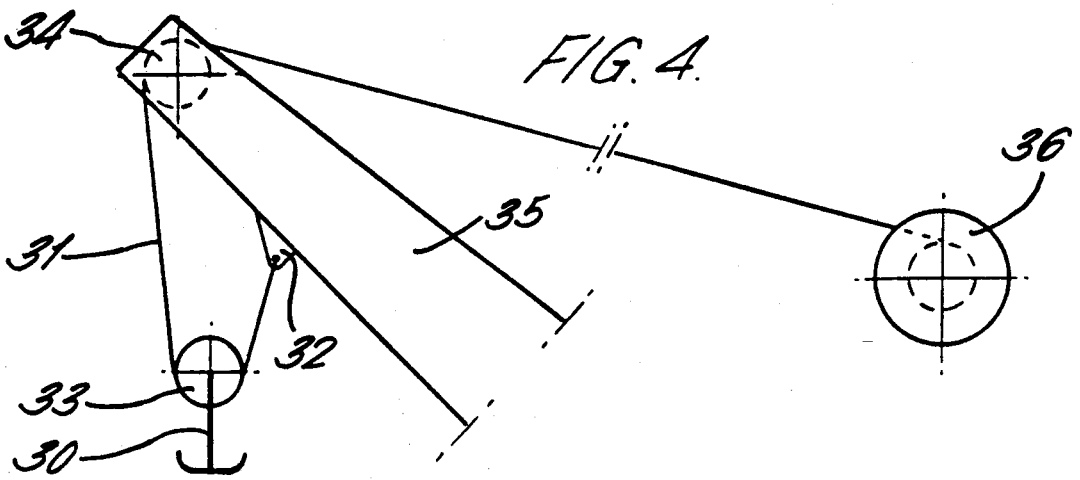
FIG. 4 illustrates a conventionally-rigged crane.
Figure 5:
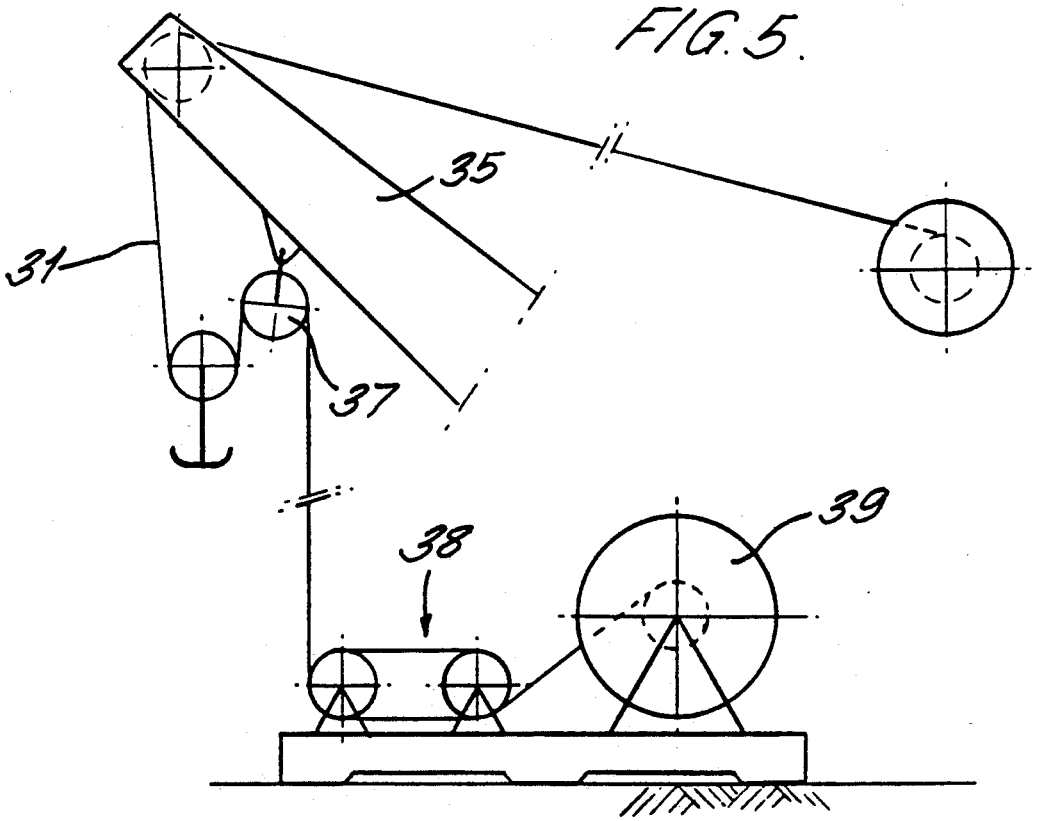
FIG. 5 illustrates a conventional crane modified in accordance with the present invention.

There is seen in FIG. 4 a typical conventionally-rigged crane. Hook 30 is suspended by cable 31 having a dead end 32. Cable 31 passes under lower pulley block 33, over upper pulley block 34 on crane boom tip 35 and onto the drum of crane winch 36. FIG. 5 shows how the crane of FIG. 4 can relatively easily be modified. Dead end 32 is replaced by a further pulley block 37 on the crane boom tip 35. Now the cable 31 is passed over the further pulley block 37 and via a traction device 38 to the drum of a storage winch assembly 39. The modification provides an increased range of block travel for an existing crane. The traction device 38 and storage winch assembly 39 may be skid mounted, e.g. on the deck of a vessel, enabling it to be used on more than one crane on deck.

Of course, if the conventional crane is one which is rigged with a cable and traction winch assembly, it may be modified in similar fashion by incorporating a winch assembly. This would improve the versatility of the crane.

Figure 6:
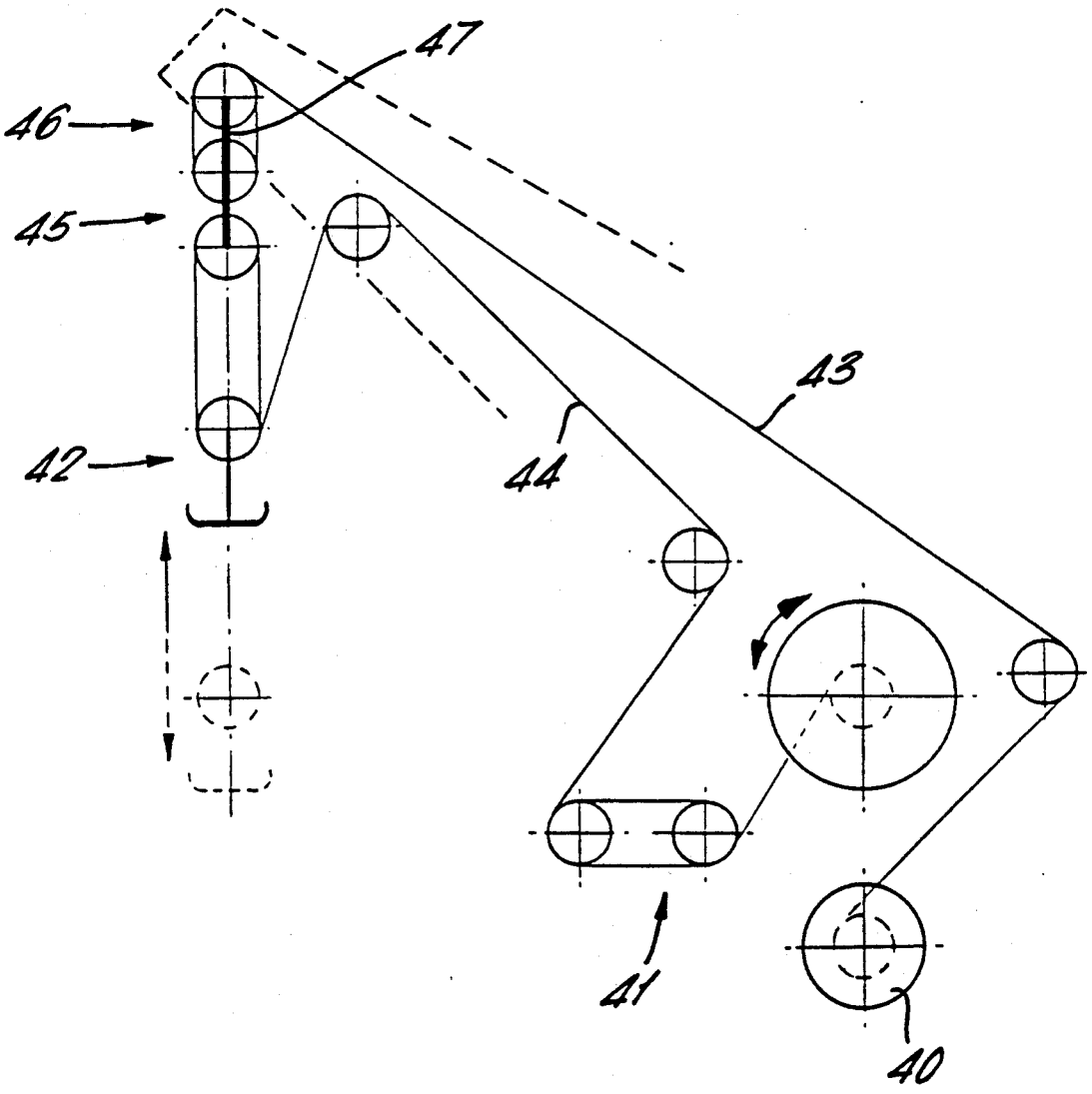
FIGS. 6 and 7 illustrate an alternative form of hoisting device using two separate cable systems in accordance with the invention.
Figure 7:
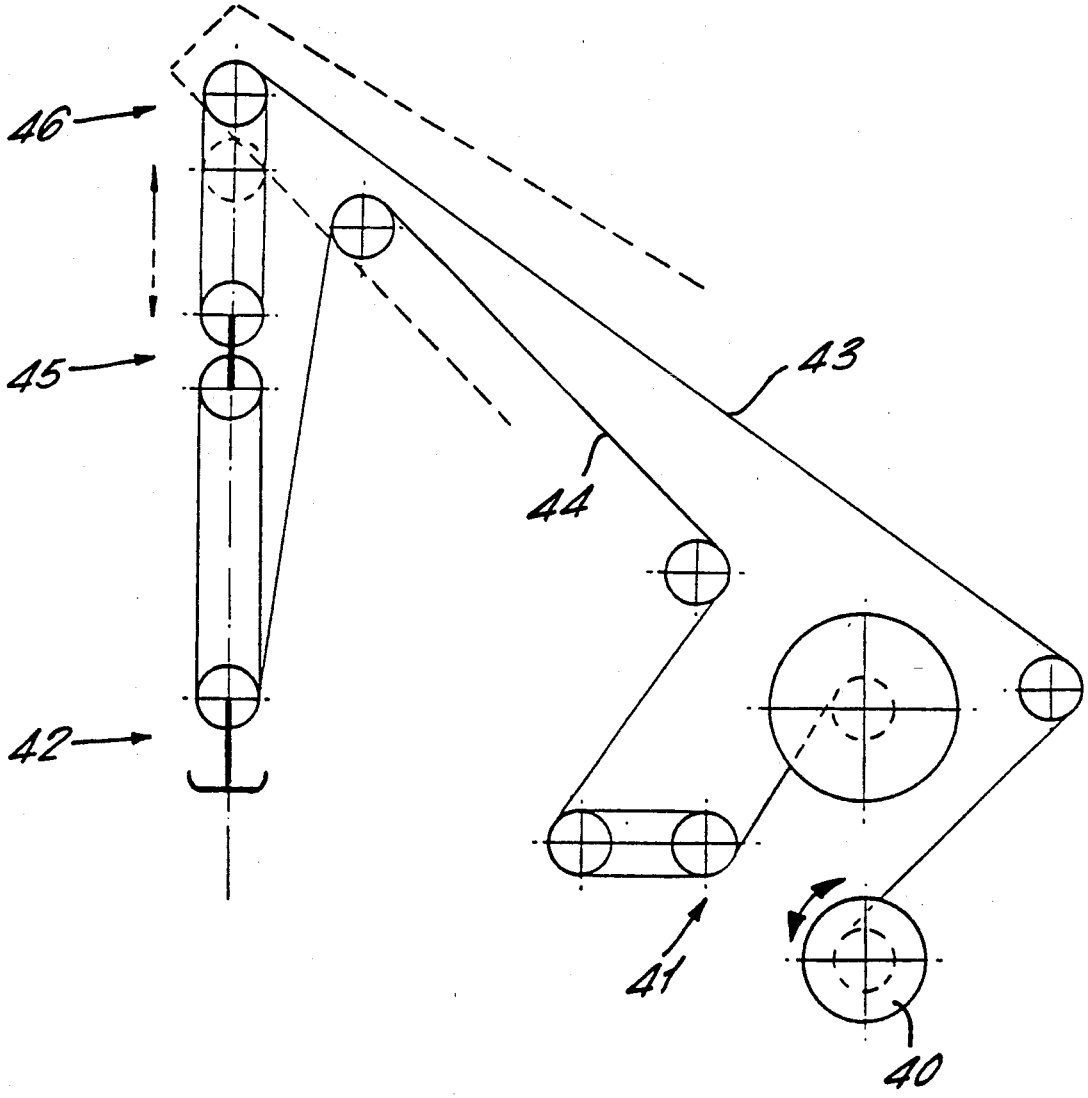
Figure 8:
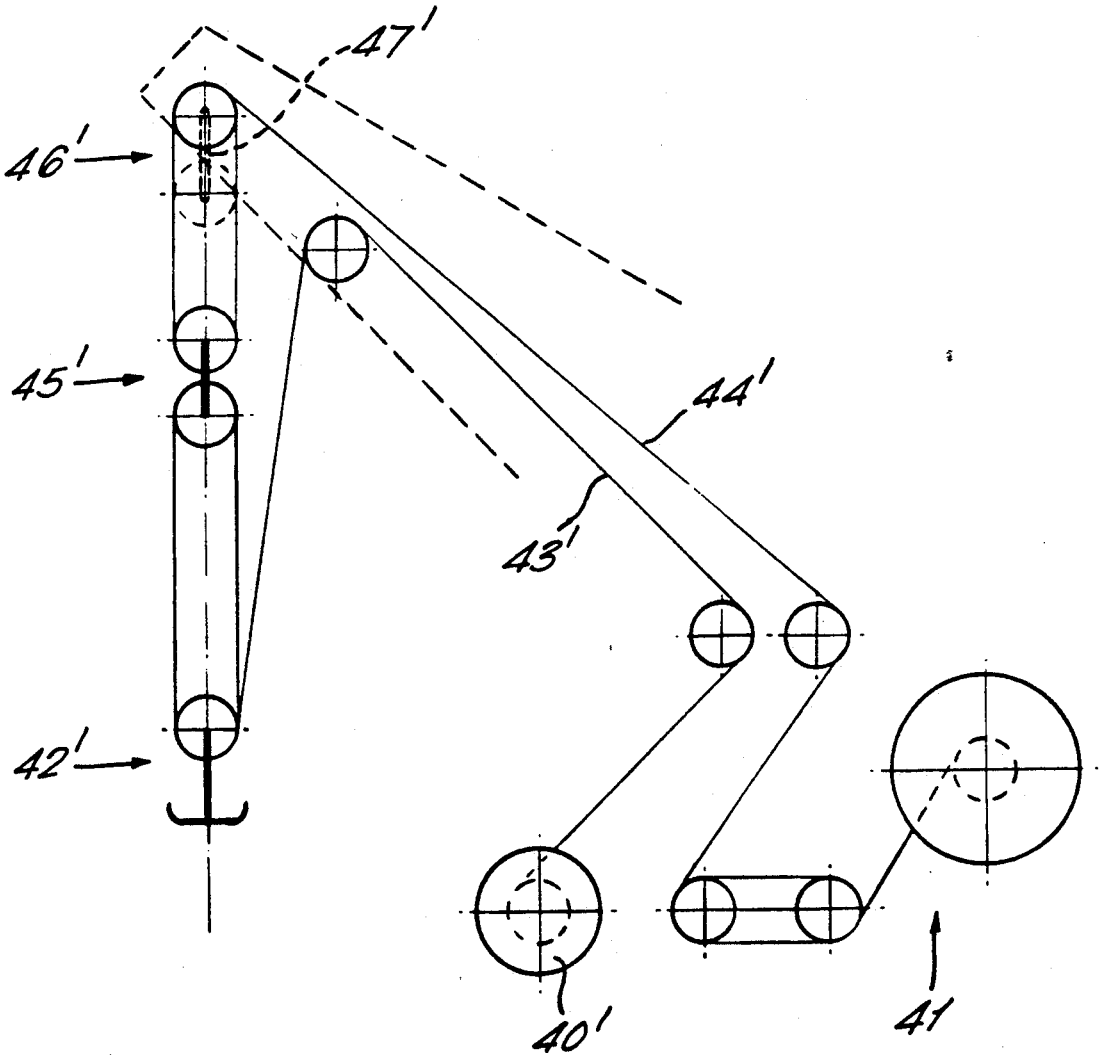
FIG. 8 illustrates an alternative two cable system arrangement.

In FIGS. 6 and 7, an alternative arrangement of hoisting device is shown. Again, both a crane winch assembly 40 and traction winch assembly 41 are provided for raising and lowering pulley block 42. Here, however, two separate cable systems 43 and 44 are used. Traction winch assembly 41 is used to control cable 44 to raise and lower pulley block 42 relative to intermediate pulley block 45. (This operation is indicated in dotted lines in FIG. 6.) Cable winch assembly 40 is used to control cable 43 to raise and lower intermediate pulley block 45 relative to upper pulley block 46. (This operation is indicated in dotted lines in FIG. 7.) There is seen in FIG. 6 a link 47 connecting together the intermediate pulley block 45 and upper pulley block 46 and providing a physical restraint during use of the crane winch assembly 41. This link 47 is removed when the crane winch assembly 40 is to be used. In FIG. 8, an alternative two cable system arrangement is seen. Here, crane winch assembly 40' controls cable 43' to raise or lower pulley block 42' relative to intermediate pulley block 42' whilst traction winch assembly 41' controls cable 44' to raise or lower intermediate pulley block 45' relative to upper pulley block 46'. Again, a removable link 47' may be used to block operation of the traction winch assembly 41' when the crane winch assembly 40' is to be used. Instead of mounting the crane winch assembly 40' on the crane or on a deck, it would of course be possible to incorporate it into the intermediate block 45' itself, and there would be some suitable control line for operating the crane winch assembly 40'.

One of the advantages of a two cable system arrangement such as shown is that it increases the hoist range of the crane. Also, the traction winch assembly can be used only for steady speed hoisting work (i.e. little or no acceleration, e.g. for long haul travel) which means a reduced power requirement for the traction winch assembly and extra useful life for its cable system. At the same time, it enables one cable system to be replaced or repaired whilst still permitting use of the crane with the other cable system.

I claim:

1. A hoisting device for handling a load through a relatively long haul non-critical operating range and a short haul critical operating range, said hoisting device comprising;

a load pick-up tackle;

cable means for suspending the load pick-up tackle;

a first load lifting winch assembly for raising and lowering the load pick-up tackle over the relatively long haul non-critical operating range;

a second load lifting winch assembly for raising and lowering the load pick-up tackle over the short haul critical range;

both load lifting winch assemblies being capable of lifting the load pick-up tackle up to its full load carrying capacity under both the short haul and long haul ranges;

said first winch assembly including a traction winch having multiple drums to reduce cable tension from the loaded pick-up tackle and a separate take-up winch to receive cable at reduced tension from the traction winch and to store a supply of cable thereon to provide for said relatively long haul cable travel and with relatively low acceleration/deceleration; and said second winch assembly including a drum onto which the cable is wound directly to raise and lower the pick-up tackle when loaded over said relatively short cable travel with high acceleration/deceleration and a fine degree of control;

said cable means being coupled to said first load lifting winch assembly and said second load lifting winch assembly for actuation selectively of said first and second winch assemblies.

2. A hoisting device as set forth in claim 1 wherein the load pick-up tackle comprises a single cable connected at one end to the traction winch and at the other end to said second winch assembly.

3. A hoisting device as set forth in claim 2 that includes means to block operation of one of the traction winch assembly and the second winch assembly when the other of the traction winch assembly and the second winch assembly is being operated.

4. A hoisting device as set forth in claim 1 wherein the cable means includes two separate cables which are connected, respectively, to the traction winch and to said second winch assembly.

5. A hoisting device as set forth in claim 4 that includes means to block operation of one of the traction winch assembly and the second winch assembly when the other of the traction winch assembly and the second winch assembly is being operated.

6. A hoisting device as set forth in claim 1 that includes means to block operation of one of the traction winch assembly and the second winch assembly when the other of the traction winch assembly and the second winch assembly is being operated.

* * * * *